United States Patent [19]

Kasper et al.

[11] Patent Number: 4,878,510

[45] Date of Patent: Nov. 7, 1989

[54] METHOD FOR REDUCING PRESSURE OF HIGHLY COMPRESSED GASES WITHOUT GENERATION OF CONDENSATION DROPLETS

[75] Inventors: Gerhard Kasper, Downers Grove; Horng-Yuan Wen, Brookfield; Yukinobu Nishikawa, Darien, all of Ill.

[73] Assignee: American Air Liquide, New York, N.Y.

[21] Appl. No.: 107,173

[22] Filed: Oct. 13, 1987

[51] Int. Cl.[4] ..... E03B 1/00

[52] U.S. Cl. ..... 137/1; 138/44

[58] Field of Search ..... 55/1, 270, 17; 73/863.21, 864.81; 138/44; 137/1; 62/86, 401

[56] References Cited

U.S. PATENT DOCUMENTS

| | | | |
|---|---|---|---|
| 1,697,344 | 1/1929 | Campbell | 138/44 |
| 4,358,302 | 11/1982 | Dahneke | 55/392 |

FOREIGN PATENT DOCUMENTS

| | | | |
|---|---|---|---|
| 330151 | 12/1920 | Fed. Rep. of Germany | 138/44 |
| 794834 | 5/1958 | United Kingdom | 55/17 |

*Primary Examiner*—Bernard Nozick

*Attorney, Agent, or Firm*—Lee C. Robinson, Jr.

[57] ABSTRACT

A method is disclosed which avoids the formation of droplets by condensation of vapors during the expansion of a highly compressed gas through a critical orifice.

The pressure drop is distributed over a sufficient number of critical orifices so as to limit the temperature drop insufficient to initiate droplet formation.

One application of the method is pressure reduction of cylinder gases without droplet formation.

14 Claims, 3 Drawing Sheets

METHOD FOR REDUCING PRESSURE OF HIGHLY COMPRESSED GASES WITHOUT GENERATION OF CONDENSATION DROPLETS

BACKGROUND OF THE INVENTION

The invention relates to a method of reducing the pressure of high pressure compressed gases without generation of droplets of condensible vapors. It also relates to a device to carry out said process.

Various impurities may be present in a compressed gas stored in a cylinder or the like, such as particles and/or vapors of condensible materials. See for example "Particle analysis in cylinder gas"—H. Y. Wen and G. Kasper—Proceedings—Institute of Environmental Sciences—May 6, 1987.

It is known from the article entitled "A gas filtration system for concentrations of $10^{-5}$ particles/cm$^{3}$" from G. KASPER and H. Y. WEN, published in Aerosol Science and Technology 5: 167–185 (1986), how to achieve "totally" particle-free process gases.

Particle analysis is today commonly carried out for a plurality of purposes, usually in conjunction with contamination studies. Since most analyzers operate at ambient pressure, and further since gases, e.g. from cylinders, can be highly compressed (up to about 2 500 psi or more), it is necessary to expand said gases to a low pressure, generally atmospheric pressure, before particle analysis can be carried out.

Up to now, the measurement of the concentration of particles in the gas at low pressure, e.g. atmospheric pressure, has been made by expanding said compressed gas directly from the high pressure of the cylinder to atmospheric pressure (see the first article cited above).

However, as disclosed in the copending application Ser. No. 107,177 filed Oct. 13, 1987, the disclosure of which is, incorporated herein by reference, entitled "Method of detecting trace amounts of condensible vapors from compressed gas"—Kasper et al.—, it has been discovered that under certain circumstances, condensible vapors, even present as trace amounts, may generate droplets of condensed vapors during the expansion of the compressed gas through a critical orifice.

If a pressure regulator which generally comprises at least one critical orifice is used for the expansion of sais compressed gas, it may thus lead to the formation of droplets which will be thereafter detected as particles by the analyzer.

Therefore, it is an object of the present invention to reduce the pressure of highly compressed gases without the introduction of condensation droplets in the expanded gas.

If is another object of the present invention to reduce the presence of highly compressed gas in order to analyze the particles present in said gas, without introducing additional particles.

SUMMARY OF THE INVENTION

According to the invention, the pressure drop between the high pressure at which the compressed gas is stored in a cylinder and the low pressure, e.g. atmospheric pressure, to which it is expanded, is distributed over a sufficient number of stages, each comprising a critical orifice, so as to limit the momentary temperature drop of the gas in each stage to a value which is insufficient to initiate droplet formation.

The spacing between two successive stages is preferably sufficient to allow the gas temperature after expansion through an orifice to return to approximately its original value before said expansion through said orifice.

One application of this method is pressure reduction of cylinder gases where recent experiments have shown that sub-ppb levels of hydrocarbon contamination cause droplet formation at pressure drops above about 20:1. Of course, such pressure drop may vary for different vapor impurities and/or carrier gases and have to be determined for each of them.

One further application of this "droplet free" pressure reduction method is the analysis of particles present in the gas before pressure reduction where the formation of droplets is a disturbing artefact. Such particle analysis is today commonly carried out for a multitude of purposes usually in conjunction with contamination studies. Since most analyzers operate at ambient pressure, while gases, e.g. from cylinders, can be highly compressed, the pressure drops may be significant.

As part of this application, a device is described for reducing gases from 200 bar to 1 bar in two stages for the purpose of particle sampling, such device having applications, among others, in pressure regulators.

DETAILED DESCRIPTION OF THE INVENTION

These and further objects will be more clearly understood by reference to the following description of various embodiments of the invention, chosen for purpose of illustration only, along with the claims and the accompanying drawings wherein:

The invention avoids the formation of condensate droplets by distributing the entire pressure drop over a sufficient number of steps so as to limit each individual pressure drop to a value where the local cooling in the jet is insufficient to cause droplet formation.

To avoid droplet formation, it is necessary to provide for sufficient space between consecutive orifices, so as to allow the gas temperature to return to its original level before expansion.

Figure 1:
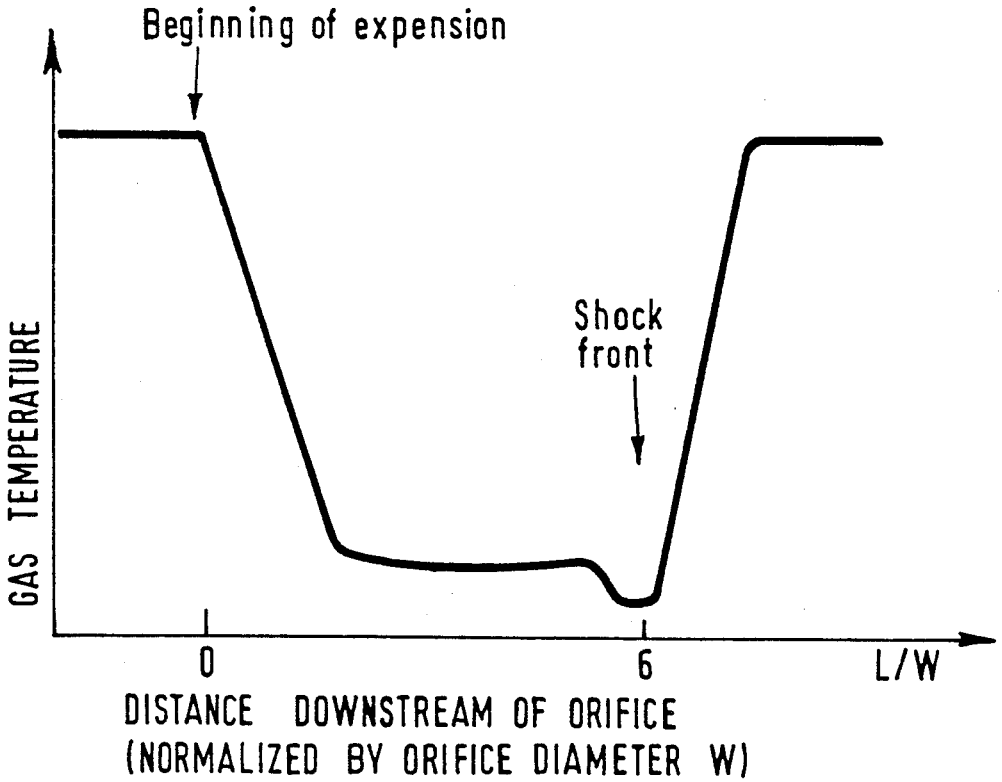
FIG. 1, represents the temperature profile of an expanding supersonic jet of gas.

The temperature profile of an expanding supersonic jet is shown in FIG. 1 which is a plot of gas temperature versus distance L downstream of orifice, normalized by orifice diameter W. Initially there is a very rapid temperature drop associated with an almost adiabatic expansion. If the expansion were perfectly adiabatic, then the low temperature $T_2$ would be $$T_2 = T_1(P_2/P_1)^{(x-1)/x}$$

where $T_2$ = temperature of gas after expansion $T_1$ = temperature of gas before expansion P2 = pressure of gas after expansion P1 = pressure of gas before expansion x = CP/CV Cp = specific heat capacity of the gas at constant pressure CV = specific heat capacity of the gas at constant volume.

x is a well known quantity for gases (e.g., x is 1.33 for nitrogen). However, the cool jet extracts some heat from the orifice, which prevents the temperature from falling all the way. This fact is actually exploited in the present invention because otherwise it would be impossible to prevent condensation even for very slight pressure drops.

At about 5 to 10 orifice diameters downstream, (FIG. 1) the gas goes through a shock wave and then rapidly returns to roughly its original temperature as it looses its kinetic energy. (The Joule Thompson effect and heat extracted from the orifice are ignored, here).

According to prefered embodiment of the invention, the method comprises a step of applying heat to the orifice, so as to avoid cooling of the orifice and its surroundings over long periods of operation.

Figure 2:
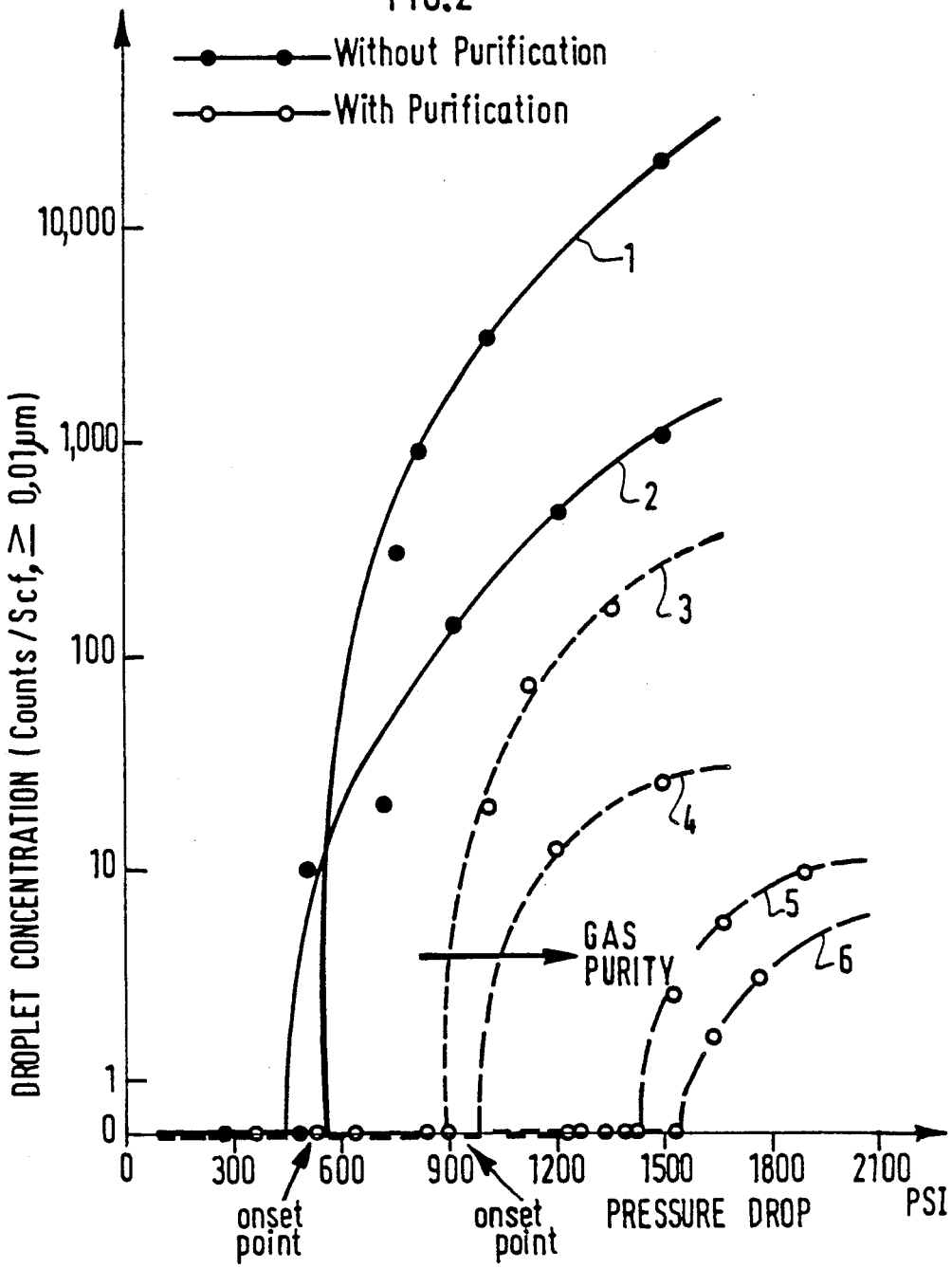
FIG. 2, shows various curves of droplets concetration versus pressure drop of gas.

FIG. 2 shows various curves of droplet concentration (counts of droplets having a diameter greater than or equal to 0.01 μm) versus pressure drop. These curves were obtained in a way disclosed in the co-pending application refered to above and incorporated in the present application.

Curves 1 and 2 represent the droplet concentration versus pressure drop for two different cylinders of nitrogen having a pressure of about 2500 psi at the beginning. The gas is filtered to eliminate particles, then expanded through a critical orifice and the droplets counted by a condensation nuclei counter. The onset points are respectively about 450 and 550 psi. Up to this pressure drop through the critical orifice, no particle was counted. Within a variation of about 50 psi of the pressure drop, about 10 droplets were counted, and at a variation higher than 50 psi of the pressure drop, 100 to 1000 droplets were counted. The onset point indicates a very important variation of the slope of the curve and thus a precise frontier.

Curves 3 and 4 represent the same as curves 1 and 2, but with the use of purifying means such as those made of molecular sieve surrounded by dry ice or an other refrigerating agent. This purifying means creates a condensation of some vapors present in the gas which has thus a lower content of condensible vapors. In curves 3 and 4, the onset of points of pressure drop are about 890 and 990 psi, respectively, and the droplet concentration is lower than that of curves 1 and 2.

Curves 5, 6 were generated using gases which were more highly purified (through more efficient purifying means) than those used to generate curves 3, 4. The onset points are thus higher (about 1440 and 1560 psi of pressure drop) and the droplet concentration still lower.

These various curves illustrate the phenomena on which the invention is based: as soon as the pressure drop of a gas across a critical orifice is sufficient, droplets of condensed vapors appear in the jet and may thus create a pertubation when the aim is to reduce the pressure of said gas without the formation of particles. This pressure drop depends, among others, on the initial concentration of condensible vapors in said gas.

Accordingly, the method of the invention is directed to the expansion of the gas through a critical orifice to a pressure drop lower than the onset pressure drop for the concentration of that gas and repeating said expansions until the desired low pressure, i.e. generally atmospheric pressure, is reached.

Figure 3:
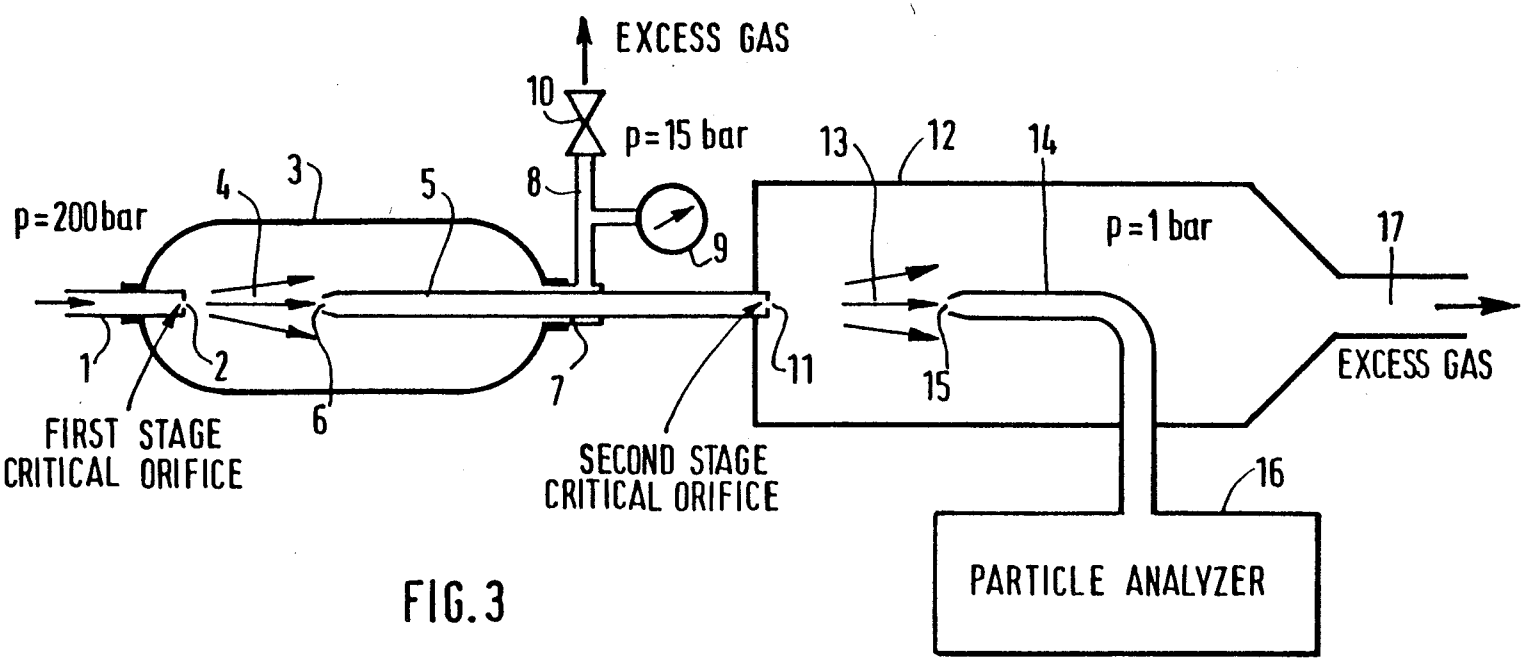
FIG. 3, shows a two-stage device used to reduce the pressure of gas from 200 bar to 1 bar without droplets formation.

FIG. 3 shows one embodiment of the invention which can be used to reduce pressures from levels of 200 bar without generating new particles to 1 bar for purposes of particle sampling.

"Particle sampling" is a commonly known procedure to obtain representative samples of particulate contamination from a gas by guiding a portion of said gas into an appropriate analytical device without incurring losses of particles or generating particles on the way.

The gas from the container, such as a cylinder (not represented) having a pressure of about 200 bar flows through the conduit 1 and the critical orifice 2, which may be surrounded by heating means, not represented on the figure, for the purpose of maintaining the temperature of said orifice 2 at an about constant temperature, if necessary.

The expanded jet 4 flows in the first expansion chamber 3 having an output 7 connected to a conduit 8 and a pressure regulation valve 10, to maintain the pressure in said expansion chamber 3 above a predetermined value, e.g. 15 bar in this example (nitrogen from a cylinder has been chosen for purposes of illustration of the present invention). The pressure in the conduit 8 is measured by the pressure gauge 9. The vent valve 10 can also be a critical orifice. The jet 4 of gas then partially enters through the input 6 and flows through the duct 5 whose output is a second critical orifice 11 through which the gas is expanded, from an intermediate pressure (e.g. 15 bar) (between the high pressure, e.g. 200 bar and the low pressure—atmospheric pressure—1 bar), to the low atmospheric pressure, in the second expansion chamber 12. The vent valve 10 (or critical orifice) allows a reduction of the volumetric gas flow rate and consequently, the gas velocity in the duct 5 approaching the next critical orifice 11. This is generally essential in this particular application of the invention to analyze particles, in order to avoid particles losses by inertial impact as is known to be the case from the article of H. Y. When and G. Kasper entitled "Particle analysis in cylinder gases" published in Proceedings—Institute of Environmental Sciences (see FIG. 2 of this article).

Venting gas in between stages is important because the expanding gas increases its volume flow rate and thus its velocity with each expansion stage. The jet 13 of gas is sampled by the sensor means 14, 15 and analyzed by the particle analyzer 16. The excess of gas is vented through the output 17 of the expansion chamber 12.

The principles set forth above are also applicable to pressure regulating devices commonly used in the gas industry. These devices function on the basis of one or two stage variable critical orifices and suffer from essentially the same problem as simple critical orifices discussed so far. FIG. 1 of the article "Particle analysis in cylinder gases" hereinbefore cited shows the significant generation of ultrafine particles (<0.1 μm) and the abrupt end of this below a critical pressure drop.

At the time of publication of this article (May 6, 1987) no explanation was given for this phenomena and the inventors had not yet proved that there is an onset pressure drop point across a critical orifice, above which condensible vapors are condensed if supersaturation may thus be created, and that the particles so detected (on FIG. 1 of said article) were both particles and condensed droplets.

The invention thus advantageously provides the basis for building multistage pressure regulators having a plurality of critical orifices which are disposed so as to avoid condensation of sub-p.p.b. or sub-p.p.t. levels of condensible vapors.

We claim:

1. A method for reducing the pressure of a high pressure compressed gas at a predetermined temperature level to a low pressure without causing condensation of condensible vapors contained in said compressed gas which comprises: causing a succession of pressure drops by expanding said high pressure compressed gas through a plurality of consecutive critical orifices into a plurality of consecutive zones, each zone having a pressure less than said high pressure and less than the previous zone; and providing for sufficient space between said consecutive orifices, so as to allow the gas temperature to return to its predetermined temperature level before further expansion, thereby creating a low pressure expanded gas, each of said pressure drops being less than a pressure drop necessary to cause condensation of said condensible vapors.

2. A method according to claim 1 further comprising the step of reducing the velocity of the gas approaching a critical orifice.

3. A method according to claim 1, further comprising a step of applying heat to at least one of the critical orifices so as to avoid cooling of said orifices.

4. A method as claimed in claim 1 which includes causing a first pressure drop in said high pressure compressed gas by expanding said gas through a first critical orifice into a first zone having an intermediate pressure between said high and low pressures and thereby creating an expanded, intermediate pressure compressed gas; and causing a second pressure drop in said expanded, intermediate pressure compressed gas by expanding said expanded, intermediate pressure compressed gas through a second critical orifice into a second zone having a low pressure and thereby creating an expanded, low pressure gas, each of said first and second pressure drops being lower than a pressure drop necessary to cause condensation of said condensible vapors.

5. A method as claimed in claim 1 wherein said pressure drop necessary to cause condensation of said condensible vapors is less than about 20:1.

6. A method according to claim 1, further comprising the step of providing a distance between two consecutive orifices sufficient to allow the gas temperature to return to approximately its original temperature before expansion through the second of said two consecutive orifices.

7. A method according to claim 6, wherein said sufficient distance is about between 5 to 10 times the diameter of the critical orifice.

8. A method for reducing the pressure of a high pressure compressed gas to a low pressure without causing condensation of condensible vapors contained in said compressed gas which comprises:

(a) causing a succession of pressure drops by expanding said high pressure compressed gas through a plurality of consecutive critical orifices into a plurality of consecutive zones, each zone having a pressure less than said high pressure and less than the previous zone, and thereby creating a low pressure expanded gas, each of said pressure drops being less than a pressure drop necessary to cause condensation of said condensible vapors; and (b) reducing the volumetric gas flow rate between two successive critical orifices.

9. A method as claimed in claim 8 which includes causing a first pressure drop in said high pressure compressed gas by expanding said gas through a first critical orifice into a first zone having an intermediate pressure between said high and low pressures and thereby creating an expanded, intermediate pressure compressed gas; and causing a second pressure drop in said expanded, intermediate pressure compressed gas by expanding said expanded, intermediate pressure compressed gas through a second critical orifice into a second zone having a low pressure and thereby creating an expanded, low pressure gas, each of said first and second pressure drops being lower than a pressure drop necessary to cause condensation of said condensible vapors.

10. A method as claimed in claim 8 wherein said pressure drop necessary to cause condensation of said condensible vapors is less than about 20:1.

11. A method as claimed in claim 8, further comprising the step of reducing the velocity of the gas approaching a critical orifice.

12. A method according to claim 8, further comprising the step of applying heat to at least one of said critical orifices so as to avoid cooling of said orifices.

13. A method as claimed in claim 8, further comprising the step of providing a distance between two consecutive orifices sufficient to allow the gas temperature to return to approximately its original temperature before expansion through the second of said two consecutive orifices.

14. A method as claimed in claim 13, wherein said distance is about five to ten times the diameter of the critical orifice.

* * * * *